US006276854B1

(12) United States Patent
Mullins

(10) Patent No.: US 6,276,854 B1
(45) Date of Patent: Aug. 21, 2001

(54) APPARATUS FOR HOLDING A WRITING UTENSIL

(76) Inventor: Eric Mullins, 17 Amador Way, Aliso Viejo, CA (US) 92656

( * ) Notice: Subject to any disclaimer, the term of this patent is extended or adjusted under 35 U.S.C. 154(b) by 0 days.

(21) Appl. No.: 09/467,107

(22) Filed: Dec. 15, 1999

Related U.S. Application Data

(60) Provisional application No. 60/112,985, filed on Dec. 17, 1998.

(51) Int. Cl.[7] ..... A45D 40/20

(52) U.S. Cl. ..... 401/88; 401/48; 401/131; 401/89

(58) Field of Search ..... 401/88, 6, 89, 401/96, 97, 95, 131, 48

(56) References Cited

U.S. PATENT DOCUMENTS

| | | | | |
|---|---|---|---|---|
| 368,517 | * | 8/1887 | Cornwall | 401/88 |
| 623,805 | * | 4/1899 | Murphy | 401/48 |
| 637,103 | * | 11/1899 | Ewald | 401/131 |
| 1,562,292 | * | 11/1925 | Coleman | 401/88 |
| 1,854,800 | * | 4/1932 | Lowenfeld | 401/88 |
| 2,385,859 | * | 10/1945 | Jacobson | 401/131 |
| 3,102,742 | * | 9/1963 | Shurcliff | 401/95 |
| 4,522,522 | | 6/1985 | Zeitelhack . | |
| 4,595,307 | * | 6/1986 | Heyden | 401/88 |
| 5,722,782 | | 3/1998 | Rosenthal . | |
| 5,779,381 | | 7/1998 | Muelver . | |
| 5,944,435 | | 8/1999 | Chai . | |

* cited by examiner

*Primary Examiner*—David J. Walczak
(74) *Attorney, Agent, or Firm*—Jackson Walker LLP

(57) ABSTRACT

A writing utensil holder protects the body of a writing utensil and allows the operator to use and store the writing utensil until it becomes too short to otherwise be effectively used or stored by the operator. It is preferred that the writing utensil holder is made of a rigid material, such as aluminum, and has a unibody construction. It is also preferred that the writing utensil holder comprises a receptacle with an upper-end opening, a lower-end opening, a plurality of incisions adjacent the lower-end opening, and a lengthwise opening made lengthwise along the receptacle. The receptacle may advantageously comprise a detent that holds a second writing utensil in place. An optional spring clip may be added for retaining the writing utensil holder in the pocket of a user or user's supply bag.

14 Claims, 3 Drawing Sheets

FIG. 1
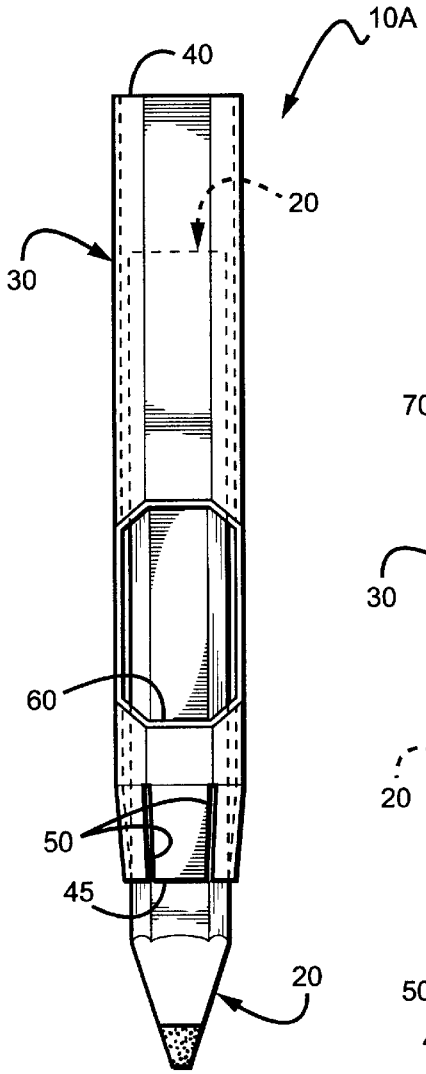
FIG. 2
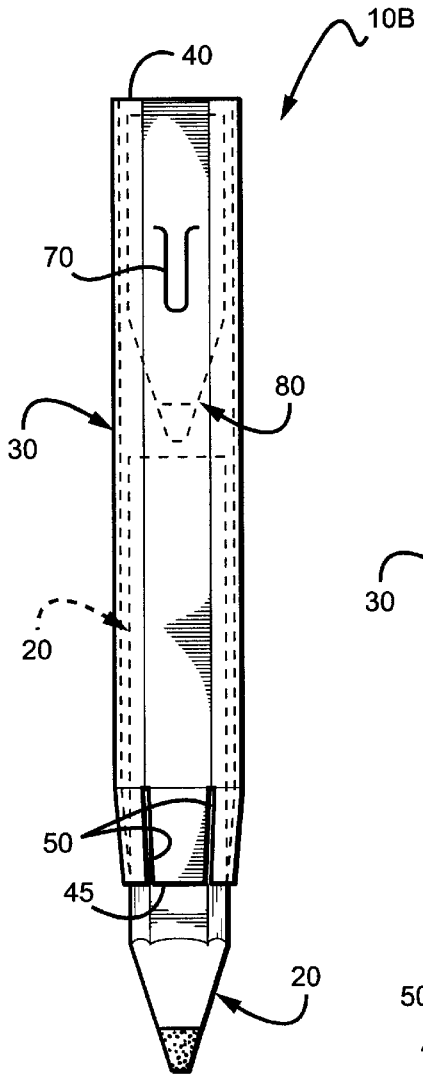
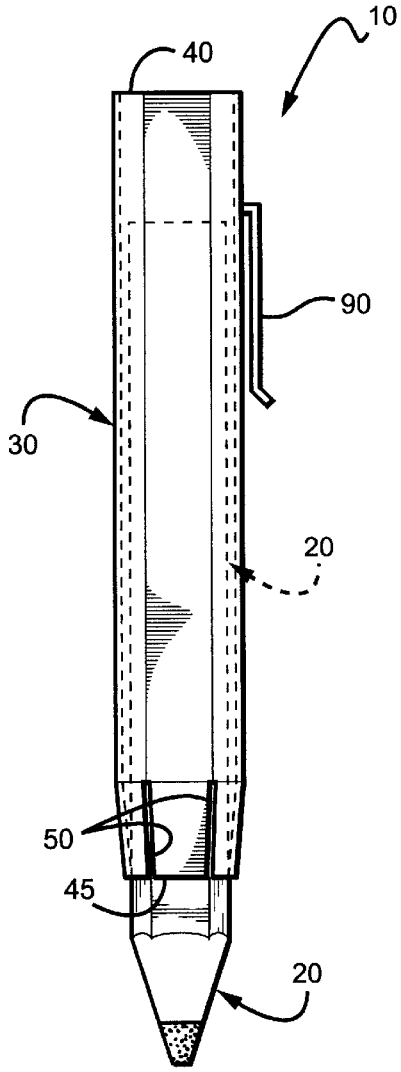
FIG. 3

FIG. 4A
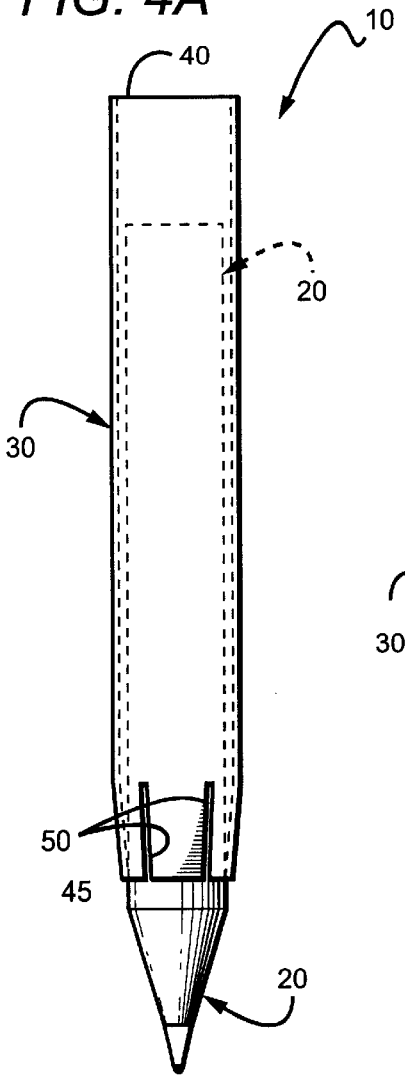
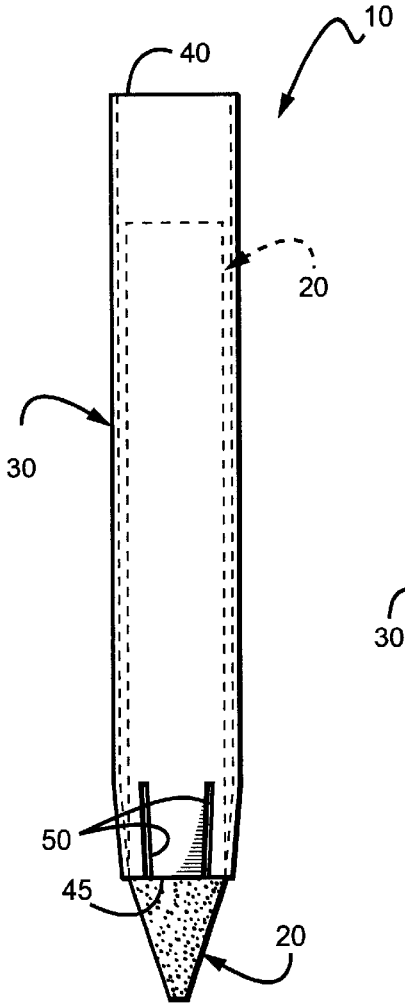
FIG. 4B
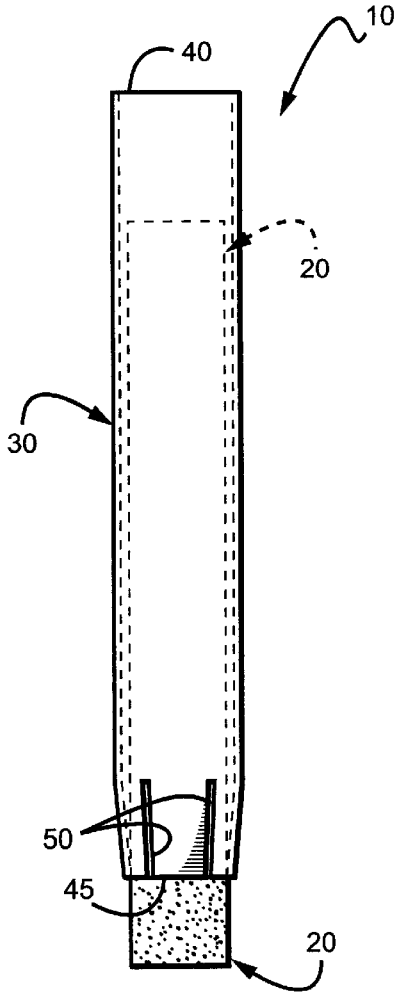
FIG. 4C

APPARATUS FOR HOLDING A WRITING UTENSIL

This application claims the benefit of U.S. Provisional Application No. 60/112,985 filed Dec. 17, 1998 incorporated herein by reference in its entirety.

FIELD OF THE INVENTION

The field of the invention is accessories for writing utensils.

BACKGROUND OF THE INVENTION

Writing utensils, including wooden pencils, chalk, and crayons are used extensively by professionals, children, teachers, and "on-site" workers, such as construction workers and architects. There is, however, a need to protect writing utensils against damage and breakage, and also a need to extend the life of writing utensils to make them economically more efficient.

U.S. Pat. No 4,522,522 issued to Zeitelhack (June 1985) describes a multi-component pencil holder that is designed to limit the protrusion of the point of a standard wooden pencil. The pencil holder is also specifically designed to receive a replaceable eraser element. However, the Zeitelhack pencil holder cannot accept other writing utensils, such as larger and/or oval wooden construction pencils, crayons or chalk. Also, the Zeitelback holder is specifically designed to be a multi-component pencil holder. Such multi-component designs do not allow for unibody constructions, and thus do not have the added advantage of simplicity.

U.S. Pat. No 5,779,381 issued to Muelver (July 1998) describes a multi-component crayon holder that is designed to receive a crayon, and to further engage the crayon when an attached plunger pushes the crayon out of the opposing end opening. Once again, the Muelver holder is specifically designed to be a multi-component holder, much like the one described by Zeitelhack.

U.S. Pat. No 5,722,782 issued to Rosenthal (March 1998) and U.S. Pat. No 5,944,435 issued to Chai (August 1999) are also similar to the Zeitelhack and Muelver holders described above in that they are multi-component pencil holding devices. The Rosenthal device has a threaded inner surface and a chuck assembly that is designed to aid in dispensing the pencil. The Chai device has a control member mounted to the pencil holding apparatus so that the user may engage and dispense the pencil from one end of the holder.

Therefore, there is still a need to provide a single component apparatus that will protect different kinds of writing utensils, including larger and/or oval construction pencils, crayons, or chalk.

Various objects, features, aspects and advantages of the present invention will become more apparent from the following detailed description of preferred embodiments of the invention, along with the accompanying drawings in which like numerals represent like components.

SUMMARY

The present invention is directed to a holder that protects the body of a writing utensil, as well as allowing the operator to use and store the writing utensil until it becomes too short to be effectively used by the operator. In preferred embodiments, this is accomplished by using a writing utensil holder that is made of a rigid material, such as aluminum, steel or composite material, and that has a unibody construction.

In preferred embodiments, a writing utensil holder designed to hold a writing utensil comprises a receptacle with an upper-end opening, a lower-end opening, a plurality of incisions adjacent the lower-end opening, and a lengthwise opening made lengthwise along the receptacle. The receptacle may also comprise a detent that holds a second writing utensil in place. An optional spring clip may be added for retaining the writing utensil holder in the pocket of a user or user's supply bag.

BRIEF DESCRIPTION OF THE FIGURES

FIG. 1 shows a preferred embodiment of the claimed holder.

FIG. 2 shows another preferred embodiment of the claimed holder.

FIG. 3 shows preferred embodiments of the claimed holder, wherein the claimed holder comprises a spring clip 90.

FIGS. 4A–4C show preferred embodiments of the claimed holder, wherein 4A shows a pen as the writing utensil 20, 4B shows a crayon as the writing utensil 20 and 4C shows a piece of chalk as the writing utensil 20.

DETAILED DESCRIPTION

Figure 5A:
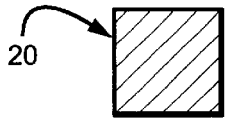
FIGS. 5A–5E shows yet other preferred embodiments of the claimed holder, wherein 5A is a cross-sectional view of a square shaped writing utensil 20, 5B is a cross-sectional view of a rectangular shaped writing utensil 20, 5C is a cross-sectional view of an octagonally shaped writing utensil 20, 5E is a cross-sectional view of a hexagonally shaped writing utensil 20, and 5D is a cross-sectional view of a triangularly shaped writing utensil 20.
Figure 5B:
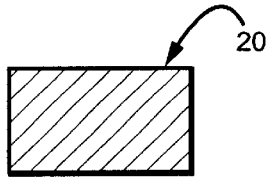
Figure 5C:
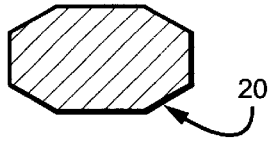
Figure 5D:
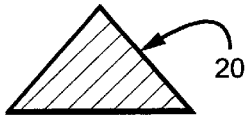
Figure 5E:
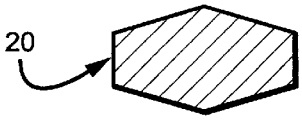
Figure 6:
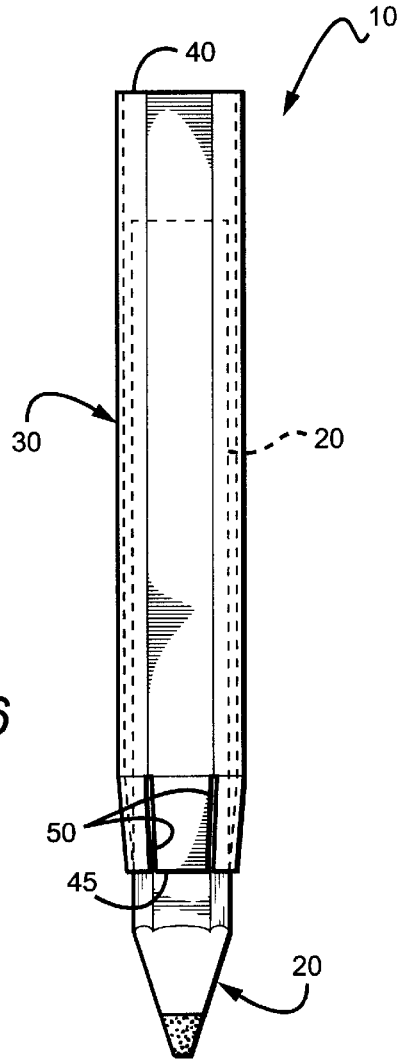
FIG. 6 shows other preferred embodiments of the claimed holder.

The present invention is directed to a holder that protects the body of a writing utensil, as well as allowing the operator to use and store the writing utensil until it becomes too short to otherwise be effectively used. In preferred embodiments, this is accomplished by using a writing utensil holder that is made of a rigid material, such as aluminum, or steel and has a unibody construction.

As used herein, the term "unibody" refers to the holder that potentially juxtaposes the writing utensil. The term "unibody" does not refer to any piece that may be attached externally to the body of the holder, such as an optional spring clip for retaining the holder in the pocket of a user or user's supply bag.

As used herein, the term "writing utensil" means any tool used for writing, including pens, pencils, crayons, and chalk. As used herein, the term "pencil" means any elongated implement for writing, drawing, or marking, usually comprising a thin rod of graphite, colored wax, or similar substance encased in wood or held in a mechanical holder.

As used herein, the term "composite material" means any combination of precursor materials such that the resulting product has improved physical properties. For example, a composite material may include a resin combined with another material, such as glass fiber, in such a way that the resulting product has improved physical properties, such as durability, temperature stability, and/or flexibility.

As used herein, the term "polymeric material" means that material comprising compounds of high molecular weight that are made up of a large number of simple molecules which have reacted with one another. Examples of polymeric materials include but are not limited to polyvinylchloride (PVC), nylon, polyurethane, polysilicones, epoxies, adhesives, thermoplastic resins, rubber compounds, polyacrylonitrile compounds, polyacrylamide compounds, styrene compounds, polyaramid compounds, vinylester compounds, and polyester compounds.

In preferred embodiments shown in FIGS. 1 and 2, a writing utensil holder 10 A, and 10 B, respectively, designed to hold a writing utensil 20 (depicted partially in phantom) comprises a receptacle 30 with an upper-end opening 40, a lower-end opening 45, a plurality of incisions 50 adjacent the lower-end opening 40, and a lengthwise opening 60 made lengthwise along the receptacle 30. Receptacle 30 may also comprise a detent 70 that holds a second writing utensil 80 (in phantom) in place. An optional spring clip 90 (not shown) may be externally attached to the writing utensil holder for retaining the writing utensil holder 10 A, and/or 10 B in the pocket of a user or user's supply bag. It is contemplated that the spring clip is externally attached by adhering, welding or otherwise affixing the clip to the writing utensil holders 10 A and/or 10 B.

In preferred embodiments, writing utensil holders 10 A and 10 B are constructed of uncoated aluminum. Writing utensil holders 10 A and 10 B contemplated herein, however, may be made or formed out of any suitable material (metal, non-metal or composite material), such as aluminum, steel, copper, PVC pipe, wood, or cardboard. Writing utensil holders 10 A and 10 B may be coated with any suitable material (metal, non-metal or polymeric material), such as paint, resin, sealant, primer, or paper.

Writing utensil 20 may comprise any tool used for writing, including pens, pencils, crayons, and chalk. Writing utensil 20 may also comprise any size or shape cross-sectional design, including circular, oval, square, rectangular, octagonal, hexagonal or triangular.

In preferred embodiments, receptacle 30 is of unibody construction and is designed to internally receive writing utensil 20. In more preferred embodiments, receptacle 30 comprises the size and shape of the writing utensil that it is designed to receive. It is contemplated, however, that receptacle 30 may comprise a mechanism that allows it to be adjustably-sized, in that receptacle 30 ultimately can receive and adjust to any size or shape of writing utensil 20. The mechanism for adjustably-sizing the receptacle 30 includes flexible claw mechanisms, and spring mechanisms.

Receptacle 30 can be imprinted, formed to include, or otherwise display visible or tactile indicia, such as company markings, company designs, school designs, and sports team markings and designs. Receptacle 30 may also receive coatings that are in the shape of company markings, company designs, school designs, and sports team markings and designs. Such coating may comprise any suitable material, including paint, metal, plastic, and composite material, and may be of any suitable color, including red, green, blue, yellow, black, and orange.

Upper-end opening 40 preferably comprises an opening that approximates the cross-sectional size and shape of the receptacle 30, and is designed to initially receive writing utensil 20. Upper-end opening 40 may also comprise a mechanism that allows it to be adjustably-sized as to adapt and adjust to the writing utensil 20 that upper-end opening 40 is receiving. The mechanism for adjustably-sizing the upper-end opening 40 includes flexible claw mechanisms, and spring mechanisms.

Lower-end opening 45 preferably comprises an opening that is slightly smaller than upper-end opening 40 and allows the end of writing utensil 20 to extend from receptacle 30. Lower-end opening 45 is contemplated to be slightly smaller than upper-end opening 40 in order to firmly hold writing utensil 20 inside of receptacle 30 as shown in FIG. 1. Lower-end opening 45 may comprise a mechanism that allows it to be adjustably-sized as to adapt and adjust to the writing utensil 20 that lower-end opening 45 is receiving. The mechanism for adjustably-sizing the lower-end opening 45 includes flexible claw mechanisms, and spring mechanisms.

A plurality of incisions 50 is advantageously cut or formed into the receptacle 30 at the lower-end opening 45 in order to provide the lower-end opening 45 with a small degree of flexibility upon receiving writing utensil 20. The plurality of incisions 50 can be cut or formed in a uniform length or may be cut or formed alternately in shorter and longer lengths, as shown in FIG. 1.

Lengthwise opening 60 in the receptacle 30 is advantageously designed to allow the operator to subsequently extend the writing utensil 20 through the lower-end opening 45. Lengthwise opening 60 may be any suitable size or shape, and the size and shape will ultimately depend on the size and shape of receptacle 30.

FIG. 2 shows an optional detent 70 that is designed to hold a second writing utensil 80 (shown entirely in phantom) firmly in place within receptacle 30. Optional detent 70 may be any suitable size or shape to hold the second writing utensil 80 firmly into place within the receptacle 30, and the size and shape will ultimately depend on the size and shape of receptacle 30.

Thus, specific embodiments and applications of holder for holding a writing utensil have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

I claim:

1. A writing utensil holder for protecting the body of a writing utensil comprising:

a receptacle having an upper-end opening, a lower end opening, a plurality of incisions adjacent the lower end opening, and a lengthwise opening made lengthwise along the receptacle, wherein the receptacle is adapted to substantially encompass and protect, couple to, and act directly on the writing utensil wherein the writing utensil has a square, a rectangular, an octagonal, a hexagonal, an oval, or a triangular cross-sectional shape.

2. The holder of claim 1, wherein the writing utensil comprises a pen, a pencil, a crayon or a piece of chalk.

3. The holder of claim 1, wherein the writing utensil is a pencil.

4. The holder of claim 1, wherein the receptacle comprises a unibody construction.

5. The holder of claim 1, wherein the receptacle is formed from metal or composite material.

6. The holder of claim 5, wherein the metal is aluminum, steel, or copper.

7. The holder of claim 1, wherein the receptacle is coated with a polymeric material.

8. The holder of claim 7, wherein the polymeric material is paint, primer, or sealant.

9. The holder of claim 1, wherein the plurality of incisions is uniformly formed into the receptacle.

10. The holder of claim 1, wherein the plurality of incisions have alternately short and long lengths.

11. The holder of claim 1, wherein the holder comprises a detent adapted to hold a second writing utensil in place within the holder.

12. The holder of claim 1, wherein the holder comprises an externally-attached spring clip.

13. The holder of claim 1, wherein the writing utensil is a cross-sectionally hexagonally shaped pencil, the receptacle has a unibody construction and is formed from steel coated with sealant, and the holder comprises a detent.

14. The holder of claim 1, wherein the writing utensil is a cross-sectionally oval shaped pencil, the holder has a unibody construction that is adjustably-sized to the writing utensil and is formed from uncoated steel, and the holder comprises an externally-attached spring clip.

* * * * *